US009750980B1

(12) United States Patent
Khalili

(10) Patent No.: US 9,750,980 B1
(45) Date of Patent: Sep. 5, 2017

(54) SELF-CONTAINED TRANSFORMABLE BALANCE BOARD

(71) Applicant: Kevin Khalili, Santa Barbara, CA (US)

(72) Inventor: Kevin Khalili, Santa Barbara, CA (US)

( * ) Notice: Subject to any disclaimer, the term of this patent is extended or adjusted under 35 U.S.C. 154(b) by 0 days.

(21) Appl. No.: 15/586,612

(22) Filed: May 4, 2017

(51) Int. Cl.
*A63B 22/18* (2006.01)
*A63B 22/20* (2006.01)
*A63B 26/00* (2006.01)

(52) U.S. Cl.
CPC ..... *A63B 26/003* (2013.01); *A63B 22/18* (2013.01); *A63B 22/20* (2013.01)

(58) Field of Classification Search
CPC ..... A63B 22/16–22/20; A63B 26/003
See application file for complete search history.

(56) References Cited

U.S. PATENT DOCUMENTS 3,379,454 A 3/1966 Woodman
4,336,952 A 6/1982 Rochman
4,505,477 A 3/1985 Wilkinson
5,399,140 A 3/1995 Klippel
6,419,586 B1 7/2002 Chiu
7,686,396 B2 3/2010 Schaaf
8,016,732 B2 9/2011 Susnjara
8,398,100 B2 3/2013 Tedla
9,220,943 B2 12/2015 Walker
9,364,716 B2 6/2016 Kramer
2007/0298947 A1* 12/2007 Eksteen ..... A63B 21/0004 482/141
2008/0079301 A1 4/2008 Schaaf
2011/0269605 A1* 11/2011 Kim ..... A63B 21/4035 482/121
2013/0296147 A1* 11/2013 Cruz ..... A63B 26/003 482/146
2015/0018178 A1 1/2015 Carbone
2015/0190679 A1 7/2015 Carbone
2015/0238793 A1 8/2015 Kramer

OTHER PUBLICATIONS

Bintiva Adjustable Balance Board Assorted Colors, website "http://bintiva.com/bn-balboard-parent-bt/", circa Oct. 2016, downloaded May 4, 2017.

* cited by examiner

*Primary Examiner* — Sundhara Ganesan
*Assistant Examiner* — Jennifer M Deichl
(74) *Attorney, Agent, or Firm* — Guy Cumberbatch

(57) ABSTRACT

A transformable balance board that may be alternately used as a balance board or wobble platform and a wheeled board or roller platform. The balance board includes a rigid platform preferably covered with a closed-cell yielding foam pad layer on top on which a user can support his or her weight. When used as a wobble platform, a relatively large central fulcrum member extends down from the rigid platform so that the board wobbles with no stable horizontal position. In a second usage configuration as a wheeled board or roller platform a plurality of sturdy wheels or rollers retracted into the underside of the rigid platform are extended vertically downward from their retracted positions. Because the vertical height of the wheels is greater than the vertical height of the fulcrum member below the rigid platform, the wheels make contact with the ground and the fulcrum is lifted up and out of contact with the floor below.

20 Claims, 4 Drawing Sheets

SELF-CONTAINED TRANSFORMABLE BALANCE BOARD

FIELD OF THE INVENTION

The present invention relates to a self-contained transformable balance board and, in particular, to a balance board having no loose parts which can be easily transformed from use as a wobble platform to use as a rolling platform, and vice a versa.

BACKGROUND OF THE INVENTION

Exercise devices have been developed for increasing strength, balance, or ability for a particular sport. Many of the devices incorporate a balance ball or half-ball of some sort, either with or without a board disposed on the ball, and with or without components that allow arm exercises. A classic balance board includes a round platform of 16-20 inches in diameter with a hemispherical fulcrum projecting from a bottom surface. The top surface may include non-slip material such as rubber.

Classic balance boards are limited in the types of exercises a user can do, and in the range of muscle groups that can be strengthened using the devices. Of course there are numerous modifications of the basic balance board, such as providing a fulcrum on the bottom of a skateboard-like platform and the like. Bintiva LLC of Lakewood, N.J. (among others) sells an adjustable balance board which comes with multiple fulcrums that can be replaced for different heights. U.S. Pat. No. 9,364,716 to Kramer also discloses an exercise board with interchangeable center and lateral accessories. Of course, these products create a problem of storing the unused fulcrums or accessories. Other balance boards featuring adjustable heights or robust springs are prohibitively expensive. Consequently, there remains a need for a simple yet more versatile transformable balance board.

SUMMARY OF THE INVENTION

The present application provides a transformable balance board that alternately functions as a classic balance board or wobble platform and a wheeled board or rolling platform.

The present application discloses a padded balance board with retractable wheels. A minimum of an 8 millimeter closed-cell yielding foam pad is on the balance board to not only allow comfort for placement of hands, forearms, feet, knees, and back but to also increase the level of difficulty, because having a yielding foam, the body is constantly challenged in order to maintain balance and stabilize the joints. Also, an inflatable half spherical pad or other destabilizing surface may be used on top of the board. A large hemispherical fulcrum member extends downward from the board a first height, and a plurality of retractable wheels may be extended from the board beyond the fulcrum member to a second height greater than the first height. The wheels add versatility for core, lower body, and upper body exercises.

Advantageously, the balance board is a completely self-contained, integrated assembly without any separate pieces or attachments for ease of function and portability. That is, moving parts attached to a rigid upper platform that enable the transformation from the balance board to the wobble platform are integrated into the platform in a manner that resists detachment without the use of tools and significant trouble. This contrasts with other convertible exercise equipment which depend on interchangeable loose parts.

BRIEF DESCRIPTION OF THE DRAWINGS

Features and advantages of the present invention will become appreciated as the same become better understood with reference to the specification, claims, and appended drawings wherein:

FIG. 5 is a perspective view of the wheel support cup of FIG. 4D shown isolated, while

DETAILED DESCRIPTION OF THE PREFERRED EMBODIMENTS

The present invention pertains to a transformable balance board that may be alternately used as a balance board or wobble platform and a wheeled board or roller platform. The balance board includes a rigid platform preferably covered with a closed-cell yielding foam layer on top on which a user can support his or her weight. When used as a wobble platform, a relatively large central fulcrum member extends down from the rigid platform so that the board wobbles with no stable horizontal position. This is the conventional configuration of a balance board. However, as the apparatus disclosed herein is termed a transformable balance board in general, the term "wobble platform configuration" will serve to define the first usage configuration. A second usage configuration is as a wheeled board or roller platform. A plurality of sturdy wheels or rollers mounted to the underside of the rigid platform remain retracted in the wobble platform configuration. To transform to the roller platform, the wheels or rollers are extended vertically downward from their retracted positions. Because the vertical height of the wheels is greater than the vertical height of the fulcrum member below the rigid platform, the wheels make contact with the ground and the fulcrum is lifted up and out of contact with the floor below.

Figure 1:
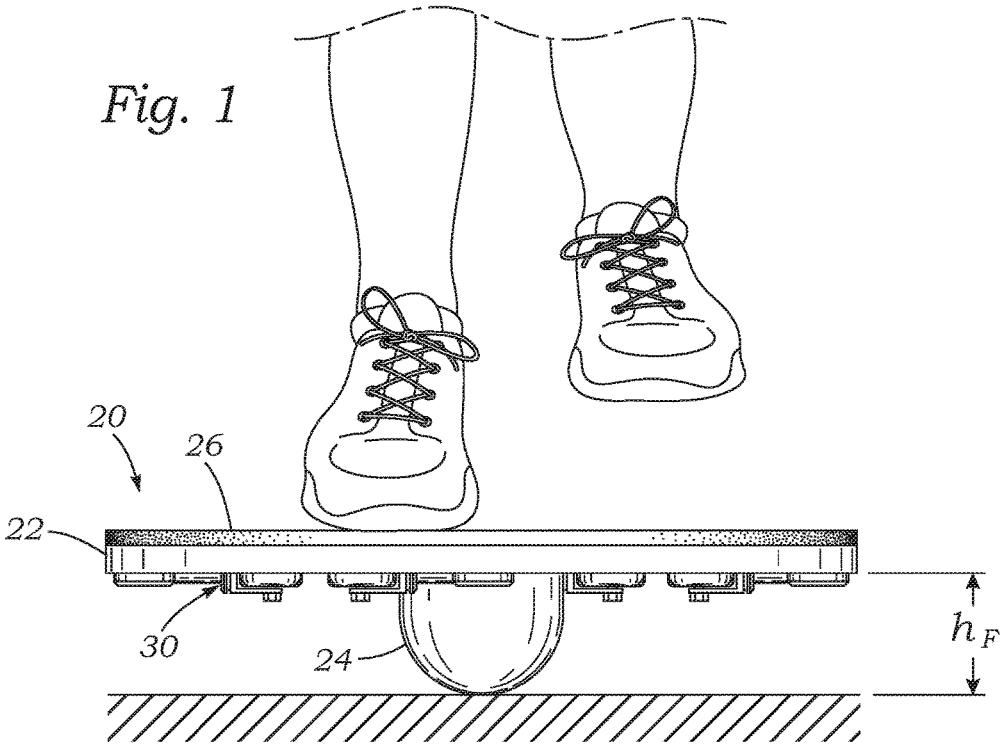
FIG. 1 is an elevational view of an exemplary transformable balance board in a first configuration that functions as a balance board or wobble platform.

FIG. 1 is an elevational view of an exemplary transformable balance board 20 in a first configuration that functions as a balance board or wobble platform. As mentioned, the balance board 20 includes a rigid platform 22 having a generally hemispherical fulcrum member 24 projecting downward therefrom. The fulcrum member 24 extends downward from the lower surface of the rigid platform 22 a height hF, which may be anywhere from 3-6 inches, and preferably 3.25 inches. A user stands on the platform, such as indicated, and performs various exercises or balancing methods, while trying to maintain the platform 22 horizontal.

In a preferred embodiment, a layer of foam 26 is preferably secured by adhesive or the like to the upper surface of the rigid platform 22 for the user's comfort. The foam layer 26 is preferably at least 8 mm thick made from a closed-cell yielding foam with an integrally molded skin and a transverse ribbing pattern for extra toughness. FIG. 1 also shows a plurality of wheels 30 retracted into the underside of the rigid platform 22.

Figure 2:
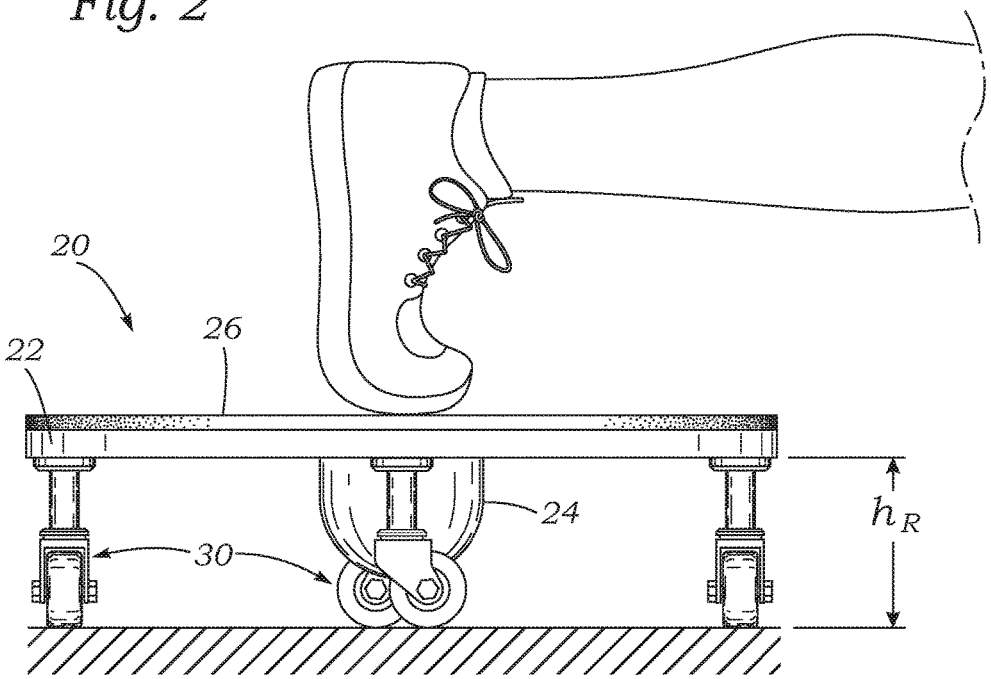
FIG. 2 is an elevational view of the exemplary transformable balance board transformed to a second configuration that functions as a wheeled board or roller platform.

FIG. 2 shows the exemplary transformable balance board 20 transformed to a second configuration that functions as a wheeled board or roller platform. In particular, the wheels 30 are extended downward into vertical positions below the rigid platform 22. When extended and secured in place, each of the wheels 30 has a height hR below the lower surface of the rigid platform 22, which is preferably about 3.5-6.5 inches, and which is always greater than the height hF of the fulcrum member 24 by at least 0.5 inches, and preferably 0.375 inch. In this way, the wheels 30 together lift the rigid platform 22 upward a sufficient distance to lift the fulcrum member 24 up from the floor below. In the wheeled board configuration, the user may place various parts of his or her body on the board, such as a foot as shown or forearms (not shown) and perform various exercises thereon. Moreover, the board 20 is relatively lightweight and can be lifted and used vertically against the wall, such as by pressing a user's back against and moving up and down the wall.

At this point, it should be understood that the terms upward/downward, upper/lower, etc., pertain to an orientation of the balance board 20 with the rigid platform 22 horizontal to a lower support surface, such as a floor. For example, in the second configuration the wheels 30 extends downward into contact with the floor and are equally sized so that the rigid platform 22 is horizontal. However, as mentioned above, the board 20 can be used against a vertical wall, or against angled surfaces, or the like. Therefore, the directional terms are relative to the conventional use of the board on a horizontal floor.

Figure 3A:
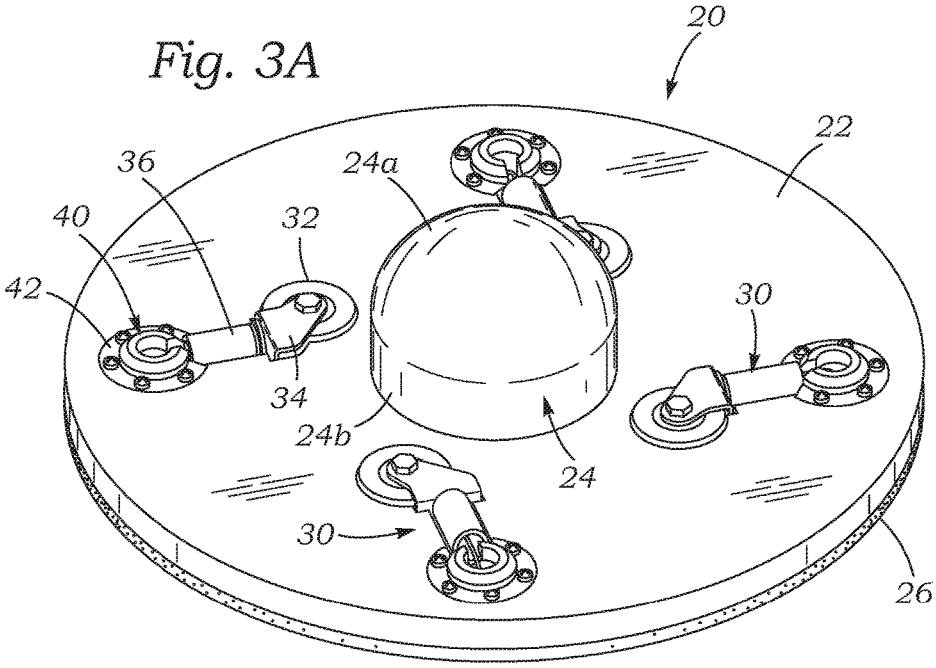
FIGS. 3A and 3B are perspective views of an underside of the transformable balance board showing a plurality of wheels respectively retracted and extended.
Figure 3B:
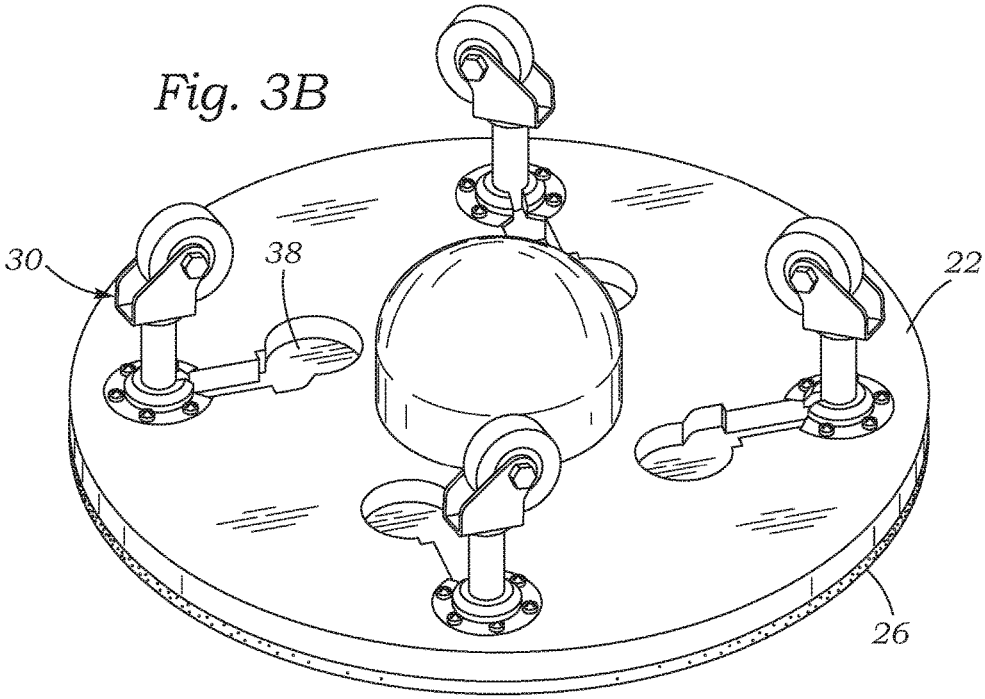

FIGS. 3A and 3B are perspective views of an underside of the transformable balance board 20 showing the plurality of wheels 30 respectively retracted and extended. Prior to a discussion of the retractable wheels 30, it should be noted that the exemplary rigid platform 22 is circular, which is a preferred shape. However, other shapes are certainly contemplated such as elongated ovals resembling skateboards, or polygonal shapes such as squares, rectangles or octagons. The platform 22 is constructed of a rigid material that will support the weight of an adult without flexing, including a variety of rigid materials such as wood, plastic, or even lightweight metal such as aluminum. It should be understood that some slight flexing may occur at least in a minimal sense with some materials, or with heavier individuals, and thus the term "without flexing" is intended to exclude those materials that are intended to flex, such as thinner polymers.

The fulcrum member 24 has a hemispherical foot 24*a* and a cylindrical body 24*b*. It should be understood also that although a hemispherical foot 24*a* is preferred, a fulcrum may be created with a wedge shape, or a conical shape, or one which is convex and rounded though not hemispherical, etc., and thus it need not be strictly hemispherical. As will be explained below, the cylindrical body 24*b* extends into a similarly sized and shaped recess in the underside of the rigid platform 22 to be secured therein. The fulcrum member 24 is desirably made of a relatively hard material such as a hard wood, dense rubber, or durable plastic.

Each of the retractable wheels 30 comprises a wheel or roller 32 rotatably supported by a bracket member 34 which swivels about the lower end of a tubular shaft 36. In the retracted position, the wheels 30 fit closely within shaped recesses 38 formed in the underside of the rigid platform 22, as seen in FIG. 3B. A portion of the wheels 30, such as the shaft 36, fits with an interference fit into the corresponding shaped recess 38 to retain the wheels 30 in the retracted position. Alternatively, a magnet may be mounted within the recess 38 which holds the wheels 30 in place. Other solution such as straps or latches may also be used. In general, the wheels 30 are retained in the corresponding recesses 38 until a user pulls them out when transforming to the extended configuration.

In a preferred embodiment, there are four retractable wheels 30 spaced evenly around the central axis of the circular platform 22, although a minimum of three wheels may be used to provide a rolled platform. Depending on the diameter of the circular platform 22, the recesses 38 may extend radially inward, or may be slightly offset from radial as seen to avoid intersecting with the fulcrum member 24. That is, in a preferred embodiment the circular platform 22 has a diameter of about 18 inches, and the retractable wheels 30 have a height hR of about 3.5-6.5 inches, so that the recesses 38 are oriented along chordal lines across the circular platform 22 rather than along radial lines.

As will be explained below, the retractable wheels 30 are tethered to the underside of the rigid platform 22, and may be extended to their vertical positions with the upper ends of the shaft 36 each held firmly within a robust wheel support cup 40 having an outer attachment flange 42.

Figure 4A:
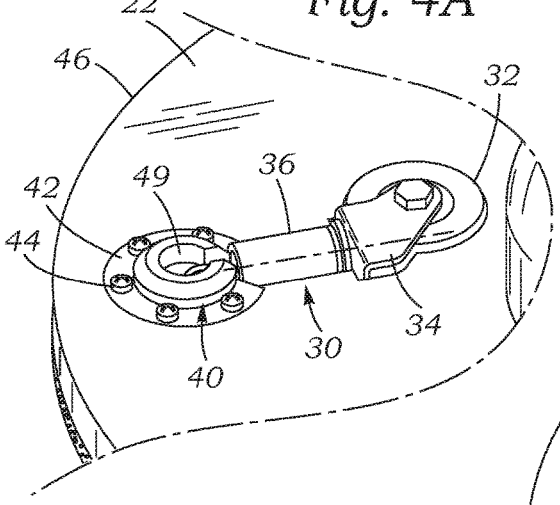
FIGS. 4A-4C are perspective views of one of the retractable wheels shown retracted, partially extended, and fully extended, respectively.
Figure 4B:
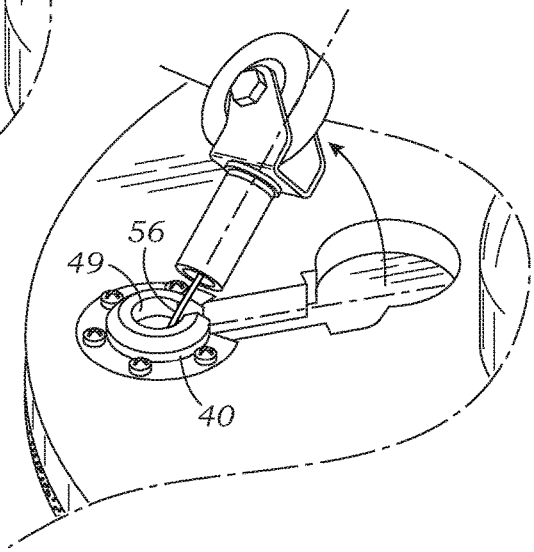
Figure 4C:
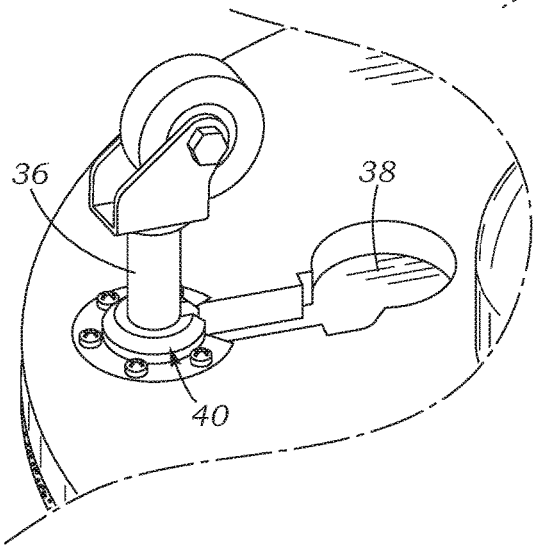

FIGS. 4A-4C are perspective views of one of the retractable wheels 30 shown retracted, partially extended, and fully extended, respectively. Fastener through holes 43 (shown in FIG. 5) are distributed around the attachment flange 42 of each wheel support cup 42 and receive a plurality of fasteners 44 to securely hold the cup into a formed recess 58 (see FIG. 6) provided on the underside of the rigid platform 22. The formed recesses 58 open to the recesses 38 into which the wheels 30 are retracted.

Figure 6:
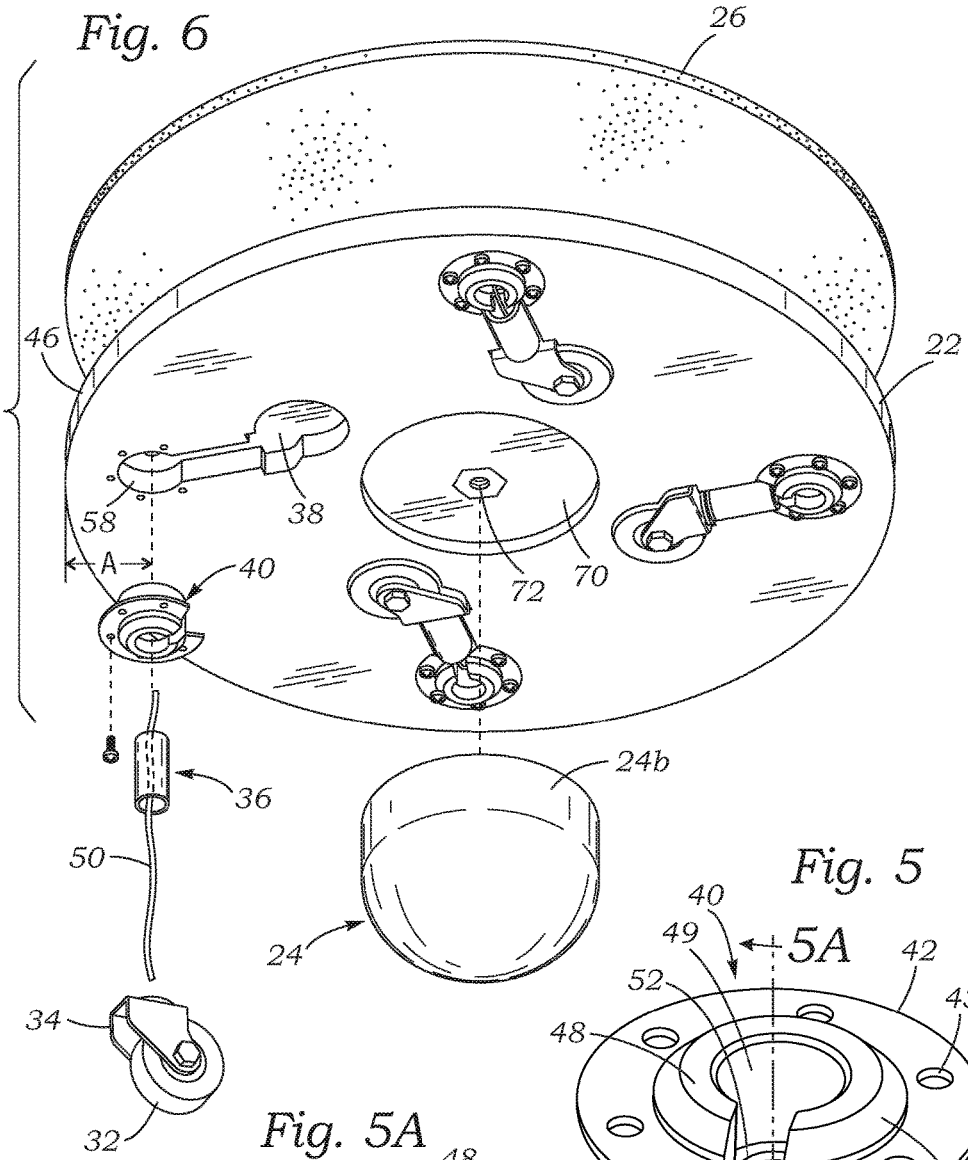
FIG. 6 is an exploded perspective view looking from the underside of the transformable balance board.

With reference to FIG. 4A, in the retracted position the wheel 30 lies flat (horizontal when the platform 22 is horizontal) within the recess 38 with the roller 32 located more toward the center of the platform, and the shaft 36 closer to a peripheral edge thereof. As seen in FIG. 6, each of the formed recesses 58 is centered a short distance A from the peripheral edge 46 of the platform 22, wherein the distance A is preferably within the range of 1-2 inches, and preferably about 1.5625 inches. In this way, when the wheels 30 are pivoted out of the recess 38 into their extended positions, they are close to the periphery 46 and thus in the aggregate provide a relatively stable rolling platform for the user.

Figure 4D:
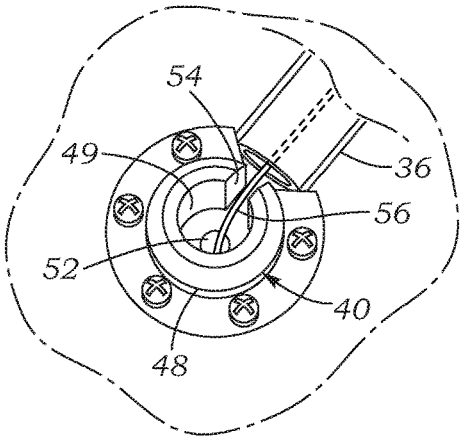
FIG. 4D is an enlarged view of a wheel support cup for the retractable wheels secured to the underside of the balance board.
Figure 5:
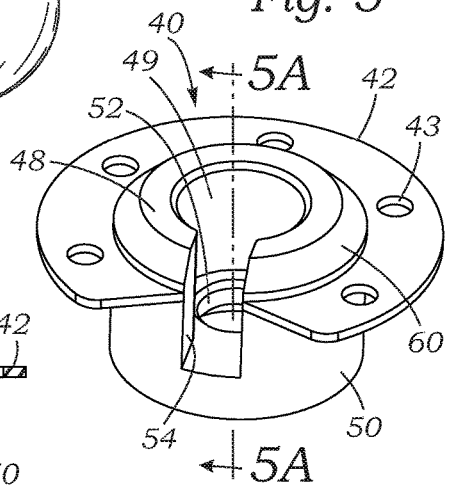
Figure 5A:
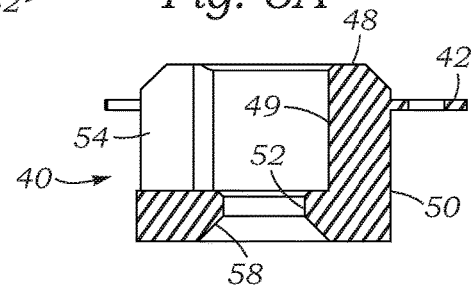
FIG. 5A is a sectional view thereof.

FIG. 4D is an enlarged view of a wheel support cup 40 secured to the underside of the balance board, while FIG. 5 is an isolated perspective view, and FIG. 5A is a sectional view thereof. (It should be understood in the following discussion that the wheel support cup 40 is shown in these views is inverted, with its underside facing upward such that the nomenclature used may appear to be reversed.) The support cup 40 includes a lower wall portion 48 defining an inner wall surface 49 and continuing upward into an upper cup-shaped wall 50 located above the flange 42. A central through bore 52 is provided at the top of the cup-shaped wall 50. The lower wall portion 48 and cup-shaped wall 50 are interrupted around one circumferential side by an axial slot 54. When assembled into the recess 58, the axial slot 54 opens downward and faces the shaped recess 58, and the retractable wheel 30. FIG. 5 also illustrates a chamfered lower corner provided on the lower wall portion 48 which helps avoid damaging the floor on which the balance board 20 is used when the wheels 30 are retracted. The wheel support cups 40 are desirably machined from a high strength steel to provide a robust and long-lasting support for the wheels 30.

With reference back to FIGS. 4A-4C, the retractable wheels 30 are secured to the underside of the rigid platform 22 via tethers 56. Each tether 56 attaches within the associated wheel shaft 36 and extends through the axial slot 54 into the wheel support cup 40, as best seen in FIG. 4D. Preferably, a tension pin (not shown) is secured diametrically through shaft 36, and the tether 56 loops around the tension pin so that two free ends exit the upper open end of shaft 36 toward and through wheel support cup 40.

The tether 56 passes through the upper through bore 52 in the wheel support cup 40 and is secured either directly to the rigid platform 22 itself via a fastener or other such apparatus (not shown), or to a knot in the tether or an attached plug (also not shown) which fits into a beveled or conical counterbore 58 that opens upward from the cup-shape wall 50. In a preferred embodiment, the two free ends of the tether 56 are secured through the upper through bore 52 using stopper knots, such as a double overhand stopper knot as seen at http://www.animatedknots.com/doubleoverhand. The beveled counterbore 58 creates a surface which prevents abrasion on the tether 56 and reduces the projection of the stopper knot from the base. The tether 50 is preferably made of a plastic-sheathed cable of high-strength to withstand numerous conversions between the retracted and extended configurations, but may also be a braided fabric cord. Optionally, the tether 56 may incorporate an elastic inner core which helps maintain the wheels 30 within the wheel support cups 40.

Due to the tethers 56, the balance board 20 is a completely self-contained, integrated assembly without any separate pieces or attachments for ease of function and portability. That is, the wheels 30 are integrated with the rigid upper platform 22 to enable the transformation from the balance board configuration to the wobble platform configuration without any interchangeable loose parts. In other words, the transformable balance board 20 is a single assembly designed to remain assembled throughout its useful life. Of course, should a tether 56 break or a wheel 30 malfunction, the fasteners 44 holding the wheel support cups 40 to the underside of the platform 22 may be removed for maintenance and replacement of parts.

The tether 56 is long enough to permit a user to detach the wheels 30 from the recesses 38 and manually pivot the shaft 36 so as to fit within the inner wall surfaces 49 of the wheel support cups 40. Each tether 56 transitions from extending through the axial slot 54 to extending generally vertically upward from the shaft 36 into the through bore 52. The diameter of the inner wall surfaces 49 is desirably approximately the same as the outer diameter of the shaft to provide an interference fit and retain the wheels within the wheel support cups 40. Alternatively, a magnetic or détente arrangement may be provide to better hold the wheels in place. Still further, a bayonet-type of latch may be used. Those of skill in the art will understand that various solutions are available for retaining the wheels 30 within the wheel support cups 40, which are also easily detachable. During use, the user is typically applying force to the top side of the balance board 20 which helps hold the wheels 30 within the wheel support cups 40.

It should be understood that alternative integrated retractable wheel mechanisms are contemplated. For instance, a hinged arrangement much like airplane wheels could be used, or one that telescopes, or screws in and out. Further, a locking structure such as a bayonet lock could be incorporated into various retractable structures. In other words, the term, "retractable wheels" pertains to a variety of different configurations, while "integrated" means that the wheels are not loose items but rather are connected to the balance board at all times.

FIG. 6 is an exploded perspective view looking from the underside of the transformable balance board. The general alignment of the assembled wheel 30 and will cup 40 into the formed recess 58 is shown. A circular recess 70 centered on the platform 22 receives the cylindrical body **24*b* of the fulcrum member 24. Although not shown, the fulcrum member 24 may have a bolt with no head, or so-called hanger bolt, centrally secured in its upper surface that is received within a base nut 72 affixed centrally within the circular recess 70. In this way, the fulcrum member 24** may be removed and replaced with one of a different height.

While the invention has been described in its preferred embodiments, it is to be understood that the words which have been used are words of description and not of limitation. Therefore, changes may be made within the appended claims without departing from the true scope of the invention.

What is claimed is:

1. A transformable balance board for use on a support surface, comprising:

an upper platform constructed of a rigid material that will support the weight of an adult without flexing, the platform having an upper surface and a lower surface;

a fulcrum member attached to and projecting downward from the lower surface of the platform, the fulcrum member extending beyond the lower surface to a fulcrum height; and at least three retractable wheels mounted to the lower surface of the platform and surrounding the fulcrum member, the wheels having a retracted configuration wherein no part of the wheels extends beyond the lower surface past the fulcrum height, and an extended configuration wherein each of the wheels extends beyond the lower surface past the fulcrum height to a wheel height such that when all of the wheels are extended and in contact with a support surface the fulcrum member is spaced from the support surface.

2. The transformable balance board of claim 1, wherein each retractable wheel includes rollers journaled for rotation at a distal end of a shaft, and wherein in the extended configuration the shaft is held perpendicular to the lower surface in a support member mounted to the lower surface of the platform and the shaft is secured parallel to the lower surface in the retracted configuration.

3. The transformable balance board of claim 2, further including a tether connecting each retractable wheel to the lower surface of the platform, the tether passing into the support member.

4. The transformable balance board of claim 2, further including a plurality of shaped recesses provided in the lower surface of the platform each of which receives a retractable wheel in the retracted configuration.

5. The transformable balance board of claim 4, wherein the upper platform is circular and the shaped recesses are aligned along chordal lines relative to the upper platform.

6. The transformable balance board of claim 1, further including a closed-cell yielding foam pad layered onto the upper surface of the upper platform and having a thickness of at least 8 millimeter.

7. The transformable balance board of claim 1, wherein the balance board is a completely self-contained, integrated assembly without any separate pieces or attachments for ease of function and portability.

8. A transformable balance board for use on a support surface, comprising:

an upper platform constructed of a rigid material that will support the weight of an adult without flexing, the platform having an upper surface and a lower surface;

a fulcrum member attached to and projecting downward from the lower surface of the platform; and four retractable wheels mounted to the lower surface of the platform and evenly surrounding the fulcrum member, a tether connecting each retractable wheel to the lower surface of the platform, wherein in an extended configuration each retractable wheel extends farther away from the lower surface than the fulcrum, and in a retracted configuration each retractable wheel is secured parallel to and under the lower surface, wherein the balance board is a completely self-contained, integrated assembly without any separate pieces or attachments for ease of function and portability.

9. The transformable balance board of claim 8, further including a plurality of shaped recesses provided in the lower surface of the platform each of which receives a retractable wheel in the retracted configuration.

10. The transformable balance board of claim 8, wherein each retractable wheel includes rollers journaled for rotation at a distal end of a shaft, and wherein in the extended configuration the shaft is held perpendicular to the lower surface in a support member mounted to the lower surface of the platform.

11. The transformable balance board of claim 10, further including a tether connecting each retractable wheel to the lower surface of the platform, the tether passing into the support member.

12. The transformable balance board of claim 11, wherein the support members each comprise a cup-shaped member with an axial slot on one side through which the tether for an associated retractable wheel passes when the retractable wheel is in its retracted configuration.

13. The transformable balance board of claim 8, further including a plurality of shaped recesses provided in the lower surface of the platform each of which receives a retractable wheel in the retracted configuration.

14. The transformable balance board of claim 8, further including a closed-cell yielding foam pad layered onto the upper surface of the upper platform and having a thickness of at least 8 millimeter.

15. A transformable balance board for use on a support surface, comprising:

an upper platform constructed of a rigid material that will support the weight of an adult without flexing, the platform having an upper surface and a lower surface;

a central fulcrum member attached to and projecting downward from the lower surface of the platform; and a plurality of retractable wheels integrated into the platform and evenly surrounding the fulcrum member, the retractable wheels having a first usage configuration wherein the wheels are retracted and the balance board functions as a wobble platform with the fulcrum member in contact with a support surface, the retractable wheels having a second usage configuration wherein the wheels are extended into contact with the support surface and the balance board functions as a wheeled board;

wherein the balance board is a completely self-contained, integrated assembly without any separate pieces or attachments for ease of function and portability.

16. The transformable balance board of claim 15, wherein each retractable wheel includes rollers journaled for rotation at a distal end of a shaft, and wherein in the extended configuration the shaft is held perpendicular to the lower surface in a support member mounted to the lower surface of the platform and the shaft is secured parallel to the lower surface in the first usage configuration.

17. The transformable balance board of claim 16, further including a tether connecting each retractable wheel to the lower surface of the platform, the tether passing into the support member.

18. The transformable balance board of claim 16, further including a plurality of shaped recesses provided in the lower surface of the platform each of which receives a retractable wheel in the first usage configuration.

19. The transformable balance board of claim 18, wherein the upper platform is circular and the shaped recesses are aligned along chordal lines relative to the upper platform.

20. The transformable balance board of claim 15, further including a closed-cell yielding foam pad layered onto the upper surface of the upper platform and having a thickness of at least 8 millimeter.

* * * * *